US009707471B2

(12) United States Patent
Popadiuk

(10) Patent No.: US 9,707,471 B2
(45) Date of Patent: Jul. 18, 2017

(54) DISPLAY FOR A PINBALL GAME

(71) Applicant: John A. Popadiuk, Bartlett, IL (US)

(72) Inventor: John A. Popadiuk, Bartlett, IL (US)

( * ) Notice: Subject to any disclaimer, the term of this patent is extended or adjusted under 35 U.S.C. 154(b) by 748 days.

(21) Appl. No.: 13/709,056

(22) Filed: Dec. 9, 2012

(65) Prior Publication Data

US 2013/0147111 A1 Jun. 13, 2013

Related U.S. Application Data

(60) Provisional application No. 61/568,817, filed on Dec. 9, 2011.

(51) Int. Cl.
*A63F 7/02* (2006.01)
*A63F 7/30* (2006.01)

(52) U.S. Cl.
CPC ..... *A63F 7/027* (2013.01); *A63F 7/02* (2013.01); *A63F 7/307* (2013.01)

(58) Field of Classification Search
USPC ..... 273/118 A, 118 R, 119 A, 119 R, 121 A, 273/121 R, 121.13, 123 A, 123 R, 127 R, 273/108
See application file for complete search history.

(56) References Cited

U.S. PATENT DOCUMENTS 4,367,876 A † 1/1983 Kotoyori
4,375,286 A * 3/1983 Seitz et al. ..... 273/121 A
4,448,417 A † 5/1984 Clark
5,149,094 A * 9/1992 Tastad ..... 273/121 A
5,632,482 A 5/1997 Anghelo
5,697,612 A * 12/1997 Piotrowski et al. ..... 273/127 R
5,700,008 A * 12/1997 Lawlor ..... A63F 7/027 273/108
5,788,230 A * 8/1998 Krise ..... A63F 7/022 273/120 A
5,806,851 A * 9/1998 Gomez et al. ..... 273/121 A
5,890,715 A * 4/1999 Gomez et al. ..... 273/118 A
6,000,697 A * 12/1999 Popadiuk et al. ..... 273/118 R
6,036,188 A 3/2000 Gomez
6,036,189 A * 3/2000 Gomez et al. ..... 273/118 R
6,059,288 A * 5/2000 Popadiuk et al. ..... 273/118 A
6,641,136 B2 * 11/2003 Huang ..... 273/121 R
8,544,846 B2 * 10/2013 Watanabe ..... G07F 17/3248 273/120 A
2001/0030392 A1 * 10/2001 Huang ..... 273/121 A
2013/0214484 A1 * 8/2013 Stellenberg ..... A63F 7/027 273/121 A

OTHER PUBLICATIONS

Ripleys (2004) http://www.sternpinball.com/downloads/ripleysbrochure.pdf.†
Monopoly (2003) http://www.sternpinball.com/downloads/MONOPOLYBrochure.pdf.†
High Roller Casino (2001) http://www.sternpinball.com/downloads/casino.pdf.†

* cited by examiner
† cited by third party

*Primary Examiner* — Nini Legesse
(74) *Attorney, Agent, or Firm* — Marsh IP Law

(57) ABSTRACT

A pinball machine or other entertainment device is provided that includes a video display and one or more sensors proximal to the display that can detect proximity of or contact with an object such as a pinball. Graphical images and/or animations can then be shown on the display, such that the images appear to directly interact with, or result from apparent contact with, the pinball or other object to provide an enhanced gameplay experience for the player.

19 Claims, 8 Drawing Sheets

DISPLAY FOR A PINBALL GAME

CROSS-REFERENCE TO RELATED APPLICATION

This application claims priority to U.S. Provisional Application Ser. No. 61/568,817, filed on Dec. 9, 2011, which is incorporated herein by reference in its entirety.

FIELD OF THE DISCLOSURE

The present disclosure relates generally to pinball games, and more specifically, to an interactive pinball game display located in close proximity to a rear portion of a pinball playfield, such that the display can be easily viewed by a player during game play and further providing visual features that can interact with physical objects in the pinball game.

BACKGROUND INFORMATION

A pinball machine typically includes an inclined playfield housed within a game cabinet, where the playfield is configured to support one or more rolling balls (pinballs) and a plurality of mechanical features that can interact with the ball(s) to score points and/or activate certain features of the game. A vertically-oriented backbox typically extends upward from a rear portion of the game cabinet and houses one or more displays, audio speakers, and/or decorative artwork. The backbox in a modern pinball machine may optionally contain game control circuitry such as, e.g., a power supply board, a processing arrangement to control game logic, a memory arrangement accessible by the processing arrangement that can store software instructions, and/or other electronic components. The display can be used to indicate player scores or other information relating to game play, and may optionally display static or animated graphical elements. For example, the display (along with associated game control circuitry) can be configured to show graphical images and suggestions to a player in response to certain events occurring on the playfield during game play, which can enhance the appeal and experience of the pinball machine. For example, the game control circuitry may cause the display to show a point value scored, or a gameplay mode being activated, in response to the pinball actuating a particular switch on the playfield.

A typical pinball machine includes two or more mechanical flippers mounted at various locations on the playfield, which are activated by buttons provided on the outside of the game cabinet. There are typically at least two flippers located on a lower end of the playfield (closest to the player) that can propel the rolling pinball up the inclined playfield to prevent it from exiting the lower end of the playfield. The flippers can be controlled by the player via the buttons to direct the pinball at various play features on the playfield, to score points, and at least partially control the play of the game.

A plurality of play features are typically provided on or proximal to the playfield surface of a pinball machine, such as targets, lanes, ramps, and the like. For example, various types of switches can be associated with the play features such that a switch is actuated in response to the pinball impacting or passing by or through a play feature. While playing a game of pinball, the player's attention is generally focused on the moving pinball (or more than one pinball that may be present on the playfield at the same time in some games). For example, a player will tend to watch the moving pinball to control timing of the flippers and aiming of the ball, and may also look at various play features on the playfield such as indicator lights to determine their status, which can affect scoring and other gameplay features.

A major drawback of mounting the display in the backbox is that the display is located away from the player's view of the playfield. Consequently, during game play, players must divert their eyes away from events occurring on the playfield in order to view the scores, graphical animations, game messages, and other visual elements that appear on the display during the game. Accordingly, some of the information provided on the display during gameplay will not be seen by the player because of the need for the player to focus on elements of the playfield.

Various approaches have been used to address the problem of having a display mounted away from the player's view of the playfield. For example, mounting a video display assembly on the rearward center portion of the playfield, physically separated from active gameplay features, is described in U.S. Pat. No. 4,375,286 to Seitz et al. However, this display is used for a video game feature that can be activated during the pinball play, and player scores are still mounted on the backbox. A pinball machine having a score display mounted on a vertical backwall behind the playfield features is described in U.S. Pat. No. 5,632,482 to Anghelo. A slanted display provided at the rearward portion of the playfield, separated from the active playfield components and mounted to the rear portion of the cabinet, is described in U.S. Pat. No. 6,000,697 to Popadiuk et al. A display system that reflects a virtual image from a video monitor across a portion of the playfield is described in U.S. Pat. No. 6,036,188 to Gomez et al. This system provides some apparent interaction between motion of the pinball and some reflected graphical display elements, but it requires a specialized cabinet with a monitor mounted overhead and special glass over the playfield that has certain reflective qualities, and the graphical images are not as bright or uniform as those viewed directly on a conventional video display.

Accordingly, it may be desirable to provide a display system for a pinball machine that is situated in a location relative to the playfield so it can be more easily seen by a player during a game than a backbox-mounted display, that can provide bright direct-view high-resolution images to display scores, game information, graphical animations, and graphical elements directly controlled by the player, that can be rotatably or slidably mounted to the playfield or cabinet to facilitate servicing or replacement, and that can further provide gameplay arrangements.

These and other objects, features and advantages of the present disclosure will become apparent upon reading the following detailed description of exemplary embodiments of the disclosure.

SUMMARY OF THE DISCLOSURE

Embodiments of the present disclosure can provide a pinball machine or other entertainment device that includes a video display capable of showing images generated or controlled by a computer processor, and one or more sensors proximal to the display that can detect proximity of or contact with an object such as a pinball. Graphical images and/or animations can then be shown on the display, such that the images appear to directly interact with, or result from apparent contact with, the pinball or other object. The display can be an LCD, LED, or OLED display, or any other arrangement capable of showing or projecting computer-generated graphic images and/or animations.

In one embodiment, the display can be located at a rear portion of the playfield, and can be substantially vertical. Such position and orientation can facilitate viewing of images on the display, including player scores and other gameplay-related information, by a player without directing the player's field of view away from the playfield itself. The vertical display orientation can also provide illumination to a portion of the playfield, and can be arranged such that little or none of the playfield is obscured by the display, allowing more playfield area to be used by playfield features. In further embodiments, the display can be provided in other locations on or near the playfield.

The display can be mounted to the playfield and or game cabinet using brackets. Such brackets can be configured to facilitate removal of or access to the display, and/or removal of the playfield without removing the display.

The sensors can be any type of sensors that can be configured to detect proximity of or contact with an object such as a pinball, including but not limited to, a mechanical switch, a magnetic or reed switch, an eddy sensor, a pressure-sensitive screen or film, an induction sensor, an opto-electronic sensor, or the like, and to generate a signal based on such detection. Such sensors can be selected, sized and/or configured to avoid visual obstruction of a significant portion of the display.

In further embodiments, a panel or plate that is at least partially clear or translucent can be provided in front of at least a portion of the display, such that images on the screen can be seen through the panel. Sensors, ball guides, and/or other gameplay features can be affixed to the panel or provided proximal to the panel. The panel can provide a surface that can withstand impact by a pinball or other object during gameplay, while presenting the appearance of the pinball striking or moving along the surface of the display.

A computer processor can be provided in communication with the one or more sensors, a memory arrangement, and the display to generate images on the display based on signals received from the sensors. The images can be generated to produce an apparent direct interaction between the pinball and the display itself or certain images displayed thereon.

In further embodiments, one or more objects can be formed using a light-conducting material and mounted proximal to the screen. Such objects, in addition to the display itself, can provide illumination of nearby portions of the playfield and other objects in the pinball machine.

BRIEF DESCRIPTION OF THE DRAWINGS

Further objects, features and advantages of the present disclosure will become apparent from the following detailed description taken in conjunction with the accompanying figures showing illustrative embodiments, results and/or features of the present disclosure, in which.

Figure 1:
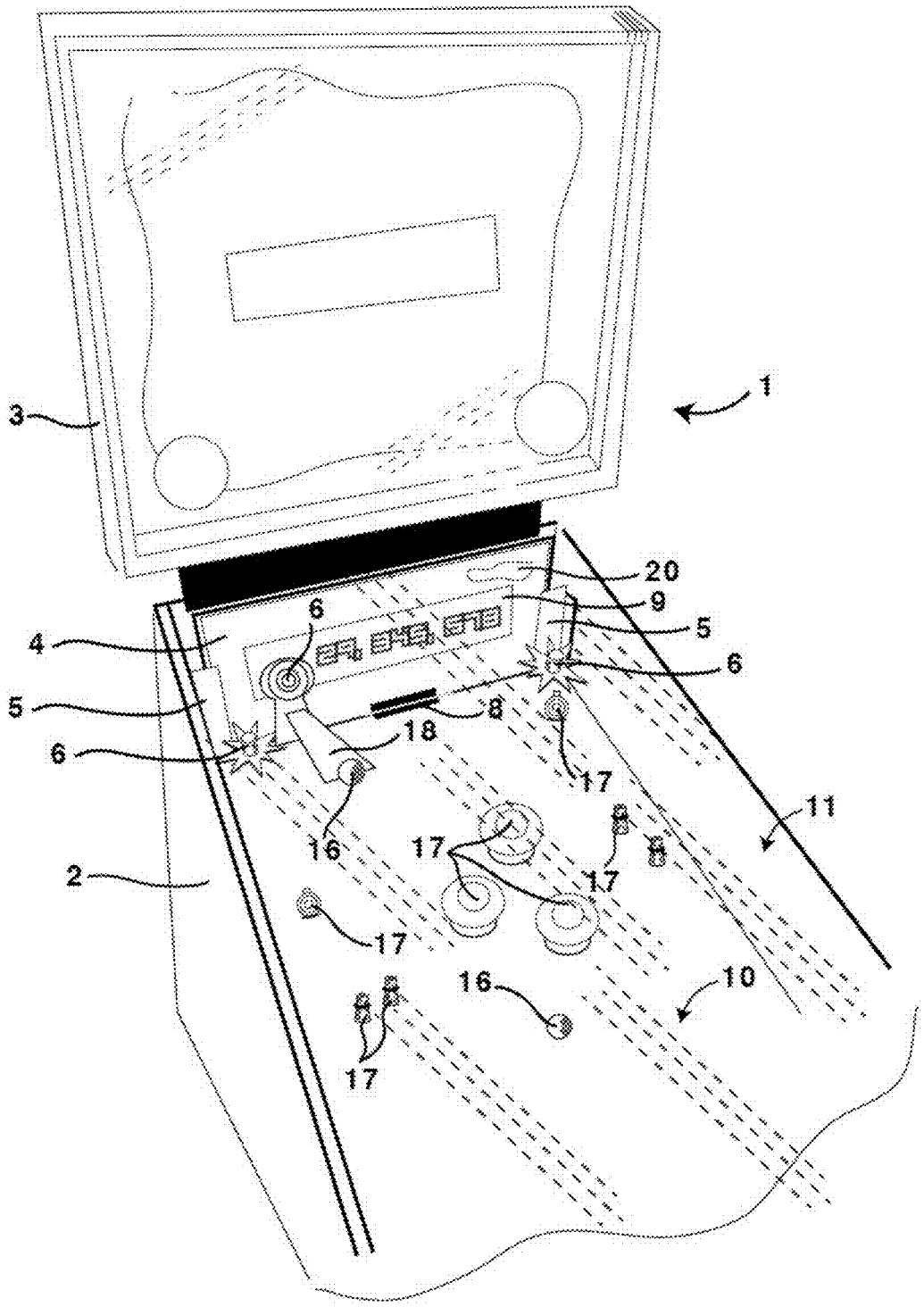
FIG. 1 is a perspective view of a portion of an exemplary pinball machine according to certain exemplary embodiments of the present disclosure.

Throughout the drawings, the same reference numerals and characters, unless otherwise stated, are used to denote like features, elements, components, or portions of the illustrated embodiments. Moreover, while the present disclosure will now be described in detail with reference to the figures, it is done so in connection with the illustrative embodiments and is not limited by the particular embodiments illustrated in the figures.

DETAILED DESCRIPTION OF EXEMPLARY EMBODIMENTS

FIG. 1 shows an illustration of a rearward portion of a pinball machine 1 in accordance with exemplary embodiments of the present disclosure. The pinball machine 1 includes a playfield surface 10 provided in a game cabinet 2, and a clear glass panel 11 mounted along an upper surface of the cabinet 2, over the playfield 10. A backbox 3 is mounted over a rearward portion of the cabinet 2. Game elements 17, such as pop bumpers, lane guides, saucers, spinners, standup targets, and the like, as well as one or more ramps 18, can be provided on the playfield, and one or more pinballs 16 can be located on the playfield 10.

The pinball machine 1 can include a video display 4 provided on or proximal to the playfield 10. For example, the display 4 can be provided in a substantially vertical orientation at the rearward portion of the playfield 10 as shown in FIG. 1. Such orientation can provide good visibility of the display 4 by a player in front of the pinball machine 1, while not obscuring any significant portion of the rearward end of the playfield 10. In further embodiments, the display 4 can be provided at other locations in the game cabinet 2. The display 4 can be configured to display images (e.g., high-resolution computer-generated graphics and animations) of gameplay-related elements as described herein, including graphical elements 20 and/or numerical scores such as that illustrated in the center of the display 4 in FIG. 1. For example, the display 4 can be configured to show certain graphical elements 20 during gameplay that can be controlled directly by a player using, e.g., flipper buttons mounted on the sides of the cabinet 2 or other controls to provide additional video-based gameplay modes and experiences.

A substantially vertical orientation of the display 4 can also provide illumination of the playfield 10 and other game elements located in front of the display 4 when it is emitting light to display images. In certain embodiments, one or more optical elements such as, e.g., reflectors or light fibers or light pipes (not shown), can be provided proximal to the display to provide directed illumination of playfield features and/or greater degrees of illumination. For example, portions of the display can be controlled by software to direct particular colors and/or intensities of light onto particular optical elements.

The display 4 can include any conventional imaging device configured to generate visible images on a screen such as, e.g., an LCD display, an LED display, an OLED display, a plasma display, or the like. In certain embodiments, the display 4 can be configured to generate three-dimensional (3D) images using conventional 3D display techniques, such as by simultaneously displaying two images having different polarizations that can be viewed by a player through polarized glasses, by displaying alternating images that are timed with shuttered glasses worn by the player, or by displaying two intertwined images that are directed to different eyes by periodic optical elements provided on the front of the display surface. In general, it is preferable that the display 4 be relatively thin, such that it can fit within the cabinet 2 without taking up a significant volume therein. In certain embodiments, the display 4 can extend across substantially the full width of the playfield 10, as shown in FIG. 1. This width can provide a large display area within the cabinet 2 to allow display of larger and/or a greater number of graphical elements such as, e.g., player scores, animations, graphical or text-based instructions or indicators of gameplay status, diagnostic information for troubleshooting, quick response codes that can be scanned by a smartphone or other device to access information relating to gameplay, etc. In certain embodiments, the display 4 may extend across only a portion of the width of the playfield 10, or be provided in other locations on or close to the playfield 10. In still further embodiments, two or more displays 4 can be provided at the rearward portion of the playfield 10 and/or in other locations.

A panel 9 can optionally be provided in front of at least a portion of the image-displaying region of the display 4. At least a portion of the panel 9 is preferably transparent or translucent, such that images generated on the display 4 can be seen through the panel 9. The panel 9 can preferably be made from a plastic or polymer such as, e.g., Plexiglas®, polycarbonate, acrylic, another impact-resistant material, or the like. During gameplay, the panel 9 can protect the display 4 from being struck by a pinball 16 that may be propelled or directed toward the display 4. The panel 9 can also be used to support one or more sensors 6 to provide interactive visual effects, as described in detail herein. In further embodiments, the display 4 can include an impact-resistant surface over at least a portion of the image display area, instead of or in addition to panel 9.

The display 4 can be mounted to the pinball machine 1 in various ways. For example, side brackets 5 can be provided within the cabinet 2, and configured to secure the display 4 (and/or optional panel 9) between them. The side brackets 5 can include substantially vertical channels such that the side edges of the display 4 and/or panel 9 can slide into them. Such a mounting configuration can facilitate removal of the display 4 for servicing and replacement, e.g., by sliding the display 4 up and out of the channels of the side brackets 5. In certain embodiments, the side brackets 5 can be affixed to a rearward portion of the playfield 10, which can facilitate removal of the display 4 together with the playfield 10 from the cabinet 2 for servicing. In further embodiments, the side brackets 5 can be mounted to side walls and/or the rear wall of the cabinet 2, such that the display 4 can remain coupled to the cabinet when the playfield 2 is removed therefrom.

In certain embodiments of the disclosure, a retaining bracket 8 can be affixed to the playfield to help couple the display 4 and/or panel 9 to the playfield 10. The retaining bracket 8 can improve the mechanical stability of these components and reduce their movement relative to the playfield 10. For example, the retaining bracket 8 can include one or more grooves configured to accommodate a portion of the lower edge of the display 4 and/or panel 9, when they are slid downwards through the side brackets 5. The retaining bracket 8 can extend along a portion of the lower edge of the display 4 and/or panel 9, as shown in FIG. 1. Alternatively, the retaining bracket 8 can extend along substantially the entire width of the lower edge of the display 4 and/or panel 9, e.g., across the width of the playfield 10. In certain embodiments, two or more retaining brackets 8 can be provided to stabilize different portions of the lower edge of the display 4 and/or panel 9. In this manner, the retaining bracket 8 can assist in mounting or positioning the display 4 and/or panel 9 relative to the playfield 10, while facilitating their removal for replacement or repair.

Embodiments of the present disclosure can also include one or more sensors 6 provided on or proximal to the panel 9 (if present) and the image-projecting region of the display 4. Such sensor(s) 6 can be configured to detect the proximity or contact of a pinball 16 or other physical element in the pinball machine 1 during gameplay. For example, the sensor 6 can be a physical target such as that shown at the top of ramp 18 in FIG. 1. Such physical target can activate a switch or otherwise generate a signal when the target portion is struck by a moving pinball 16, e.g., when the pinball 16 is launched up the ramp 18 towards the display 4. The contact portion of the target can optionally be small in size and/or made of a clear material so that little or none of the display behind it is visually obstructed. The sensor 6 can also be a switch element provided proximal to the front of the display 4, such as the star-shaped sensors 6 shown near the lower left and right corners of the display 4 in FIG. 1. In further embodiments, the sensor 6 can be a touch-sensitive or pressure-sensitive film or surface provided on at least a portion of the display 4 or panel 9. Such touch-sensitive surfaces can be activated by pressure or inductance, such as those that are used on the screens of some computing tablets, smartphones, and other entertainment devices. In certain embodiments, the display 4 and sensor 6 can be part of the same structure, e.g., as a conventional touchscreen. These sensors 6 can also provide a signal when a pinball 16 or other moving game feature contacts or is proximal to the sensor 6.

Any sensor capable of detecting a physical impact or proximity of an object such as a pinball 16, and generating a signal based on such detection, can be used in embodiments of the present disclosure. For example, the sensor 6 can include a physical contact switch, an optical or opto-electronic detector, an eddy sensor, a reed switch or other magnetic switch, an induction sensor, an acoustic sensor, etc. A sensor 6 can optionally be mounted directly onto the panel 9 or the front of the display 4, depending on which type of sensor is used. For example, sensor 6 can include a length of thin wire configured as an eddy sensor that can be affixed to a surface of the panel 9 or display 4, with a control circuit for the eddy sensor connected to but located away from the thin wire. Although the sensor 6 shown at the top of the ramp 18 in FIG. 1 is relatively large, in certain embodiments the sensor 6 can be selected so that it does not visually obstruct a substantial portion of the images shown on the display 4, or the sensor 6 can be positioned so that it only visually obstructs a peripheral or non-critical region of the display 4.

Figure 2:
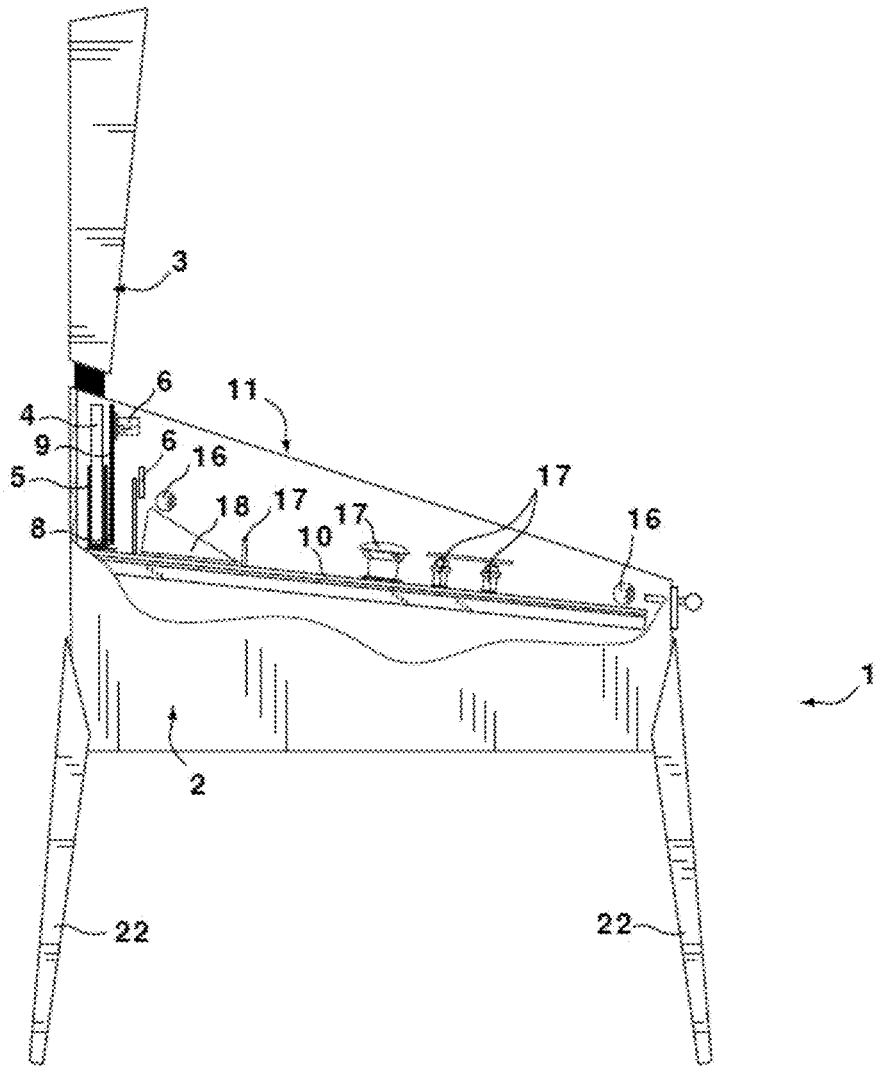
FIG. 2 is a cutaway side view of an exemplary pinball machine according to exemplary embodiments of the present disclosure.

A side view of the exemplary embodiment of a pinball machine 1 is shown in FIG. 2. The pinball machine 1 includes a cabinet 2, backbox 3, and top glass 11, which are supported by legs 22 affixed to the cabinet 2. The upper portion of the side of the cabinet 2 is cut away in FIG. 2 to reveal the playfield 10 and other features described above. For example, the display 4 is shown being held in place by side bracket 5, with panel 9 provided between the display 4 and the main area of the playfield 10. Also shown in FIG. 2 are exemplary game features such as ramp 18, assorted game elements 17, and pinballs 16. The side view of FIG. 2 illustrates how the vertical orientation of the display 4 can provide graphical images on the display 4 that can be seen by a player standing in front of the pinball machine 1 (to the right side of FIG. 2) when looking in the general direction of the playfield 10 during gameplay. This vertical orientation of the display 4 also avoids significant obstruction of the far end of the playfield 10 (at the left of FIG. 2), which provides a larger surface on which the pinball 16 can travel and game elements 17 can be located.

Figure 3:
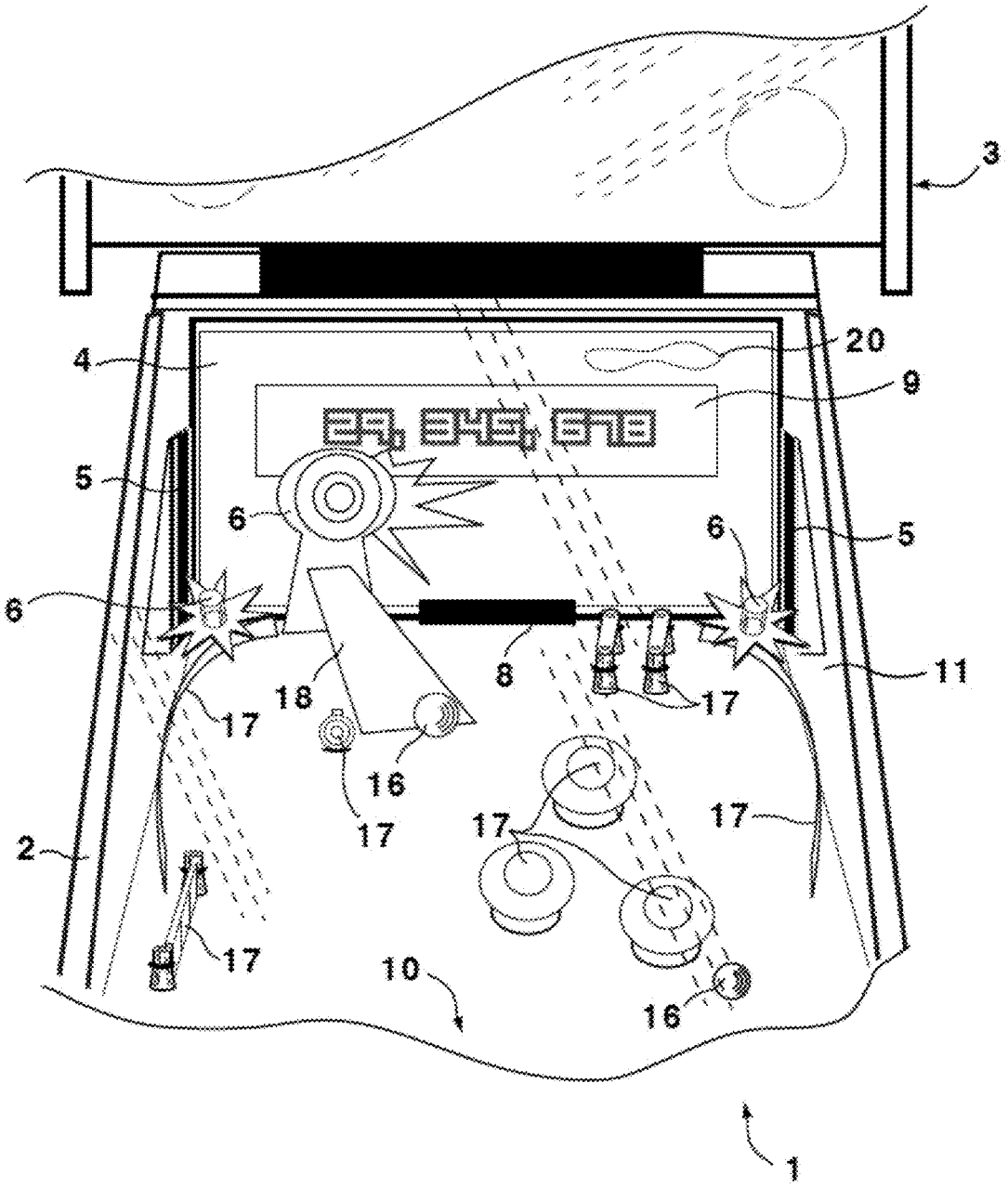
FIG. 3 is a frontal view of a portion of an exemplary pinball machine according to exemplary embodiments of the present disclosure.

A frontal view of the far end portion of the pinball machine 1 is shown in FIG. 3. The playfield 10, cabinet sides 2, and upper glass sheet 11 can be seen in this figure. The display 4 and panel 9 are held in position by side brackets 5 and retaining bracket 8. Exemplary game elements 17 are shown mounted on the playfield 10 in front of the display 4. The exemplary ramp 18, pinball 16, sensors 6, and a portion of the backbox 3 are also shown in FIG. 3.

The viewing angle shown in FIG. 3 corresponds approximately to the view a player will see when playing a game. It is apparent from this perspective that a player can simultaneously look at, e.g., the pinball(s) 16, game elements 17, and other objects on the playfield 10 while also seeing the images provided on the display 4. In this manner, the position and orientation of the display 4 can provide an improved experience for the player by facilitating viewing of displayed graphics without taking the player's line of sight away from the objects on the playfield 10.

Figure 4A:
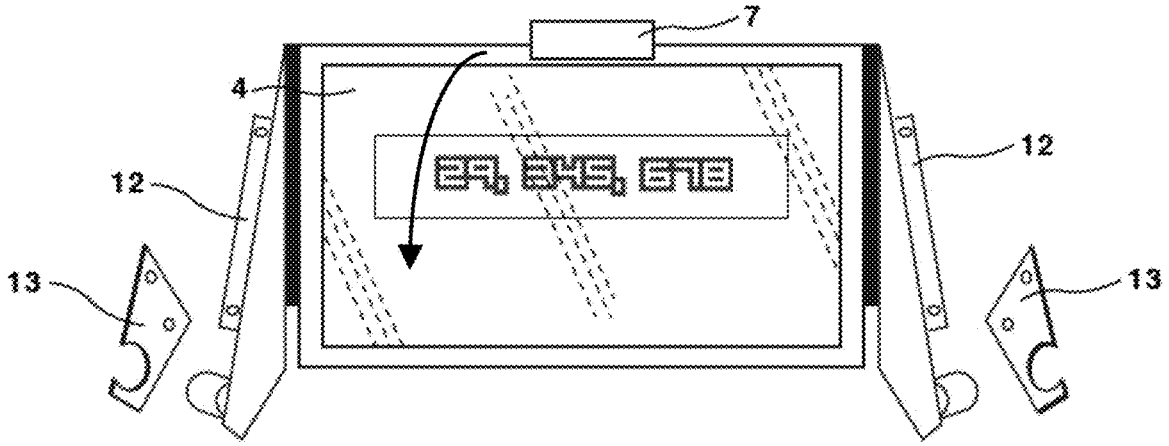
FIG. 4A is a frontal view of an exemplary display mounting arrangement according to another exemplary embodiment of the present disclosure.
Figure 4B:
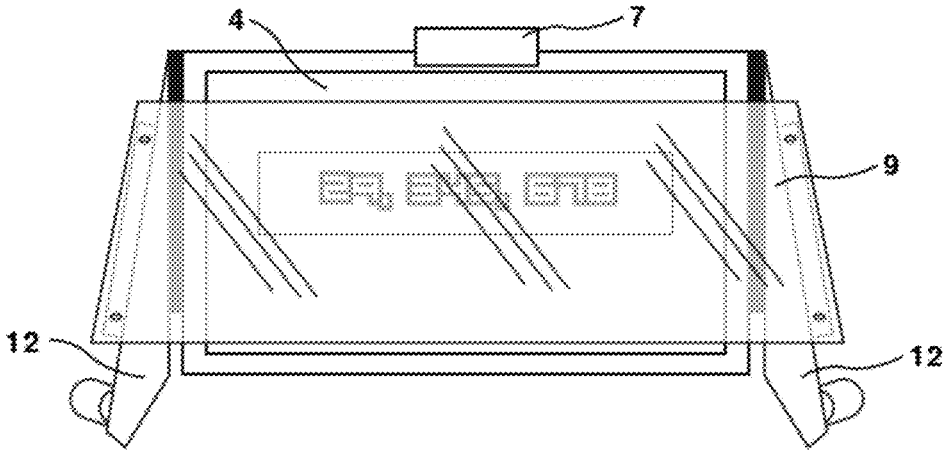
FIG. 4B is a further frontal view of the exemplary display mounting arrangement shown in FIG. 4A.
Figure 4C:
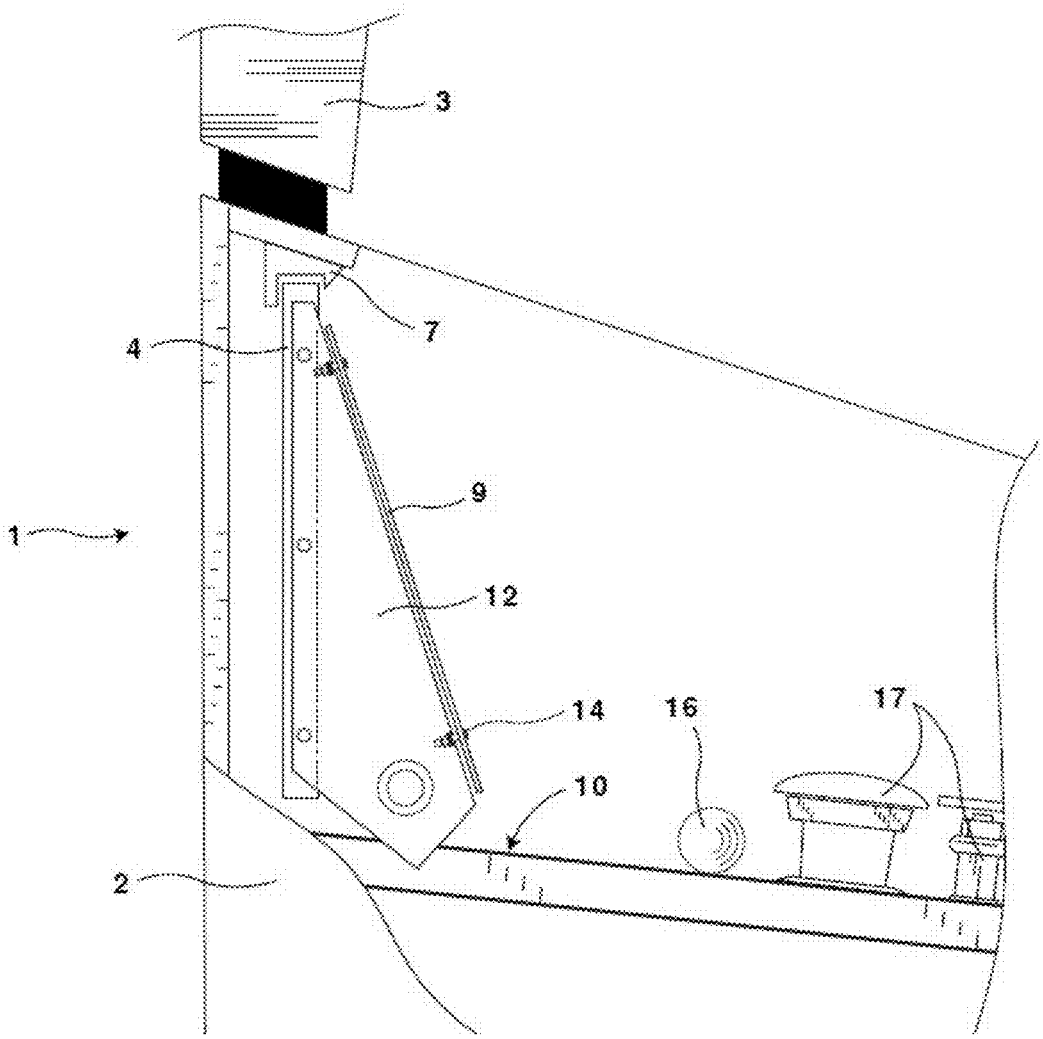
FIG. 4C is a side view of the exemplary display mounting arrangement shown in FIG. 4A.

In a further embodiment of the disclosure, an alternative mounting configuration for the display 4 and panel 9 are shown in FIGS. 4A-4C. FIG. 4A shows the display 4 with a pair of angled side supports 12 affixed to the side edges thereof. The side supports 12 include a rounded protrusion located at the lower front end thereof. A pair of pivot brackets 13 that include rounded cutouts are also shown in an exploded view in FIG. 4A. These pivot brackets 13 can be mounted to the inside walls of the side cabinet, such that the rounded cutouts line up with the rounded protrusions of the side brackets 12. This configuration allows the display 4 and side supports 12 to pivot forward in the direction of the arrow shown in FIG. 4A, e.g., to provide easy access to the rear portion of the display 4 and/or any components located behind the display 4 in the cabinet 2. A removable clip 7 can be provided along the top edge of the display 4 to lock the display 4 in place during use, where the clip 7 can be removed or shifted to allow the display 4 to pivot forward when desired.

FIG. 4B shows the display 4 and side supports 12, with the panel 9 mounted to the slanted forward edge of the side supports 12, e.g., with fasteners 14. A side view of this mounting arrangement is shown in FIG. 4C, where a portion of the cabinet 2 is cut away to reveal the components inside the cabinet 2. The display 4 and attached side supports 12, together with protective panel 9, are shown in the exemplary positions they would have when the pinball machine 1 is being played. The pivot bracket 13 is not shown in this figure for clarity. Clip 7 can be seen to constrain the forward pivoting of the display 4 when it is positioned as shown in FIG. 4C. The side view in FIG. 4C illustrates how the display 4 can be provided in a vertical orientation at the rearward end of the playfield 10 without being affixed to the playfield 10 or cabinet 2. Instead, the display 4 (and panel 9) are supported by side supports 12, which rest in the cutout of the pivot brackets 13 (not shown in the cutaway view of FIG. 4C) that are affixed to the interior sides of the cabinet 2. This mounting configuration permits the playfield 10 to be slid to the left and upward for removal or access to the underside thereof, while allowing the display 4 and panel 9 to remain stationary within the cabinet 2. As described above and shown in FIG. 4A, this mounting configuration also permits the display 4 to be pivoted forward for access without moving the playfield 10. The panel 9, although illustrated as slanting forward relative to display 4 in FIG. 4C, can be provided at any angle relative to the display 4 (by varying the shape of side supports 12), including substantially parallel to and adjacent to the front of display 4.

Figure 5:
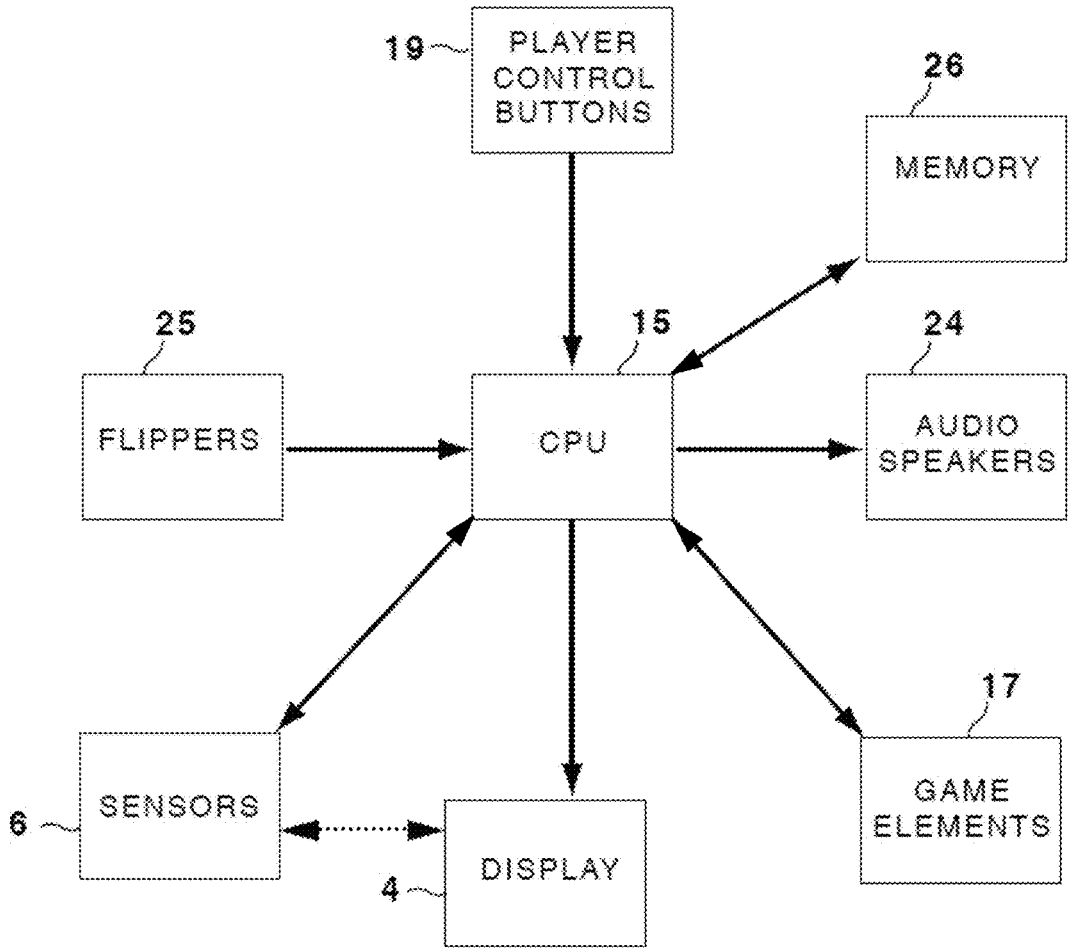
FIG. 5 is an exemplary schematic chart of the interacting elements provided in a pinball machine according to exemplary embodiments of the present disclosure.

In addition to providing improved visibility for displayed graphical elements in a pinball machine during gameplay and general illumination to the far portion of the playfield 10, the display 4 described herein can be used in conjunction with the sensors 6 to provide new and different types of interactive experiences in a pinball game. An exemplary schematic illustration of the physical and electronic components of a pinball machine in accordance with embodiments of the present disclosure is shown in FIG. 5. The CPU 15 can be any known computer or processor arrangement provided in communication with the various components shown in FIG. 5. For example, the CPU 15 can be a conventional PC or microprocessor system, an embedded processor, or the like. The CPU 15 can access instructions and/or data from memory arrangement 26, and it may also store and/or modify data in memory arrangement 26. The principal interaction of a player with the pinball machine is via control buttons 19 (e.g., conventional pinball flipper buttons), which can send signals to the CPU 15 when pressed. The CPU can, in response, activate flippers 25 and/or other controllable game elements 17. The CPU can also control generation of sounds by audio speakers 24. In certain embodiments, the CPU 15 can be configured to generate one or more sounds through the audio speakers 24 based on a signal received from the sensor 6. Certain ones of the various game elements 17 can be configured to generate signals that are received by the CPU 15, e.g., when they are activated by particular events such as motion or impact of a pinball 16, activation of other game elements 17, or the like. The CPU 15 can also access data and instructions from memory arrangement 26 and send signals to the display 4 to generate visible images thereon.

In addition to these operations, which can be provided by conventional pinball machines, embodiments of the present disclosure can further provide apparent interactions between physical objects such as, e.g., a pinball 16, and graphical objects shown on the display 4 via sensors 6. This is indicated by the dashed line between the sensors 6 and display 4 shown in FIG. 5. For example, the sensors 6 can be provided proximal to the display 4 as described herein. When a moving physical object in the game activates a sensor 6, the signal generated by the sensor 6 to the CPU 15 can then cause an appropriate graphical image or animation to be generated on the display 4 or a portion thereof, which may be proximal to the sensor 6 that was activated. This can create the illusion of a physical object directly causing a graphical response that can be viewed by the player.

As a specific example, a pinball 16 can be projected up the ramp 18 shown in FIG. 3 such that it impacts the target sensor 6 located at the upper end of the ramp 18. The struck sensor 6 can then send a signal to the CPU 15, which in turn sends signals to the display 4 to generate an image of, e.g., an explosion proximal to the target sensor 6. In this manner, the pinball 16 appears to strike the display 4 directly and cause an explosion on it. Other graphical images generated on the display 4 such as, e.g., images of targets or spaceships, can also appear to be directly affected by the pinball 16 when it strikes a sensor 6 proximal to the image on the display. The pinball may actually contact the panel 9, and merely appear to strike the display. The panel 9 can also be more resistant to impact than the display 4, and it may be designed to be more easily replaced and at lesser expense.

Figure 6:
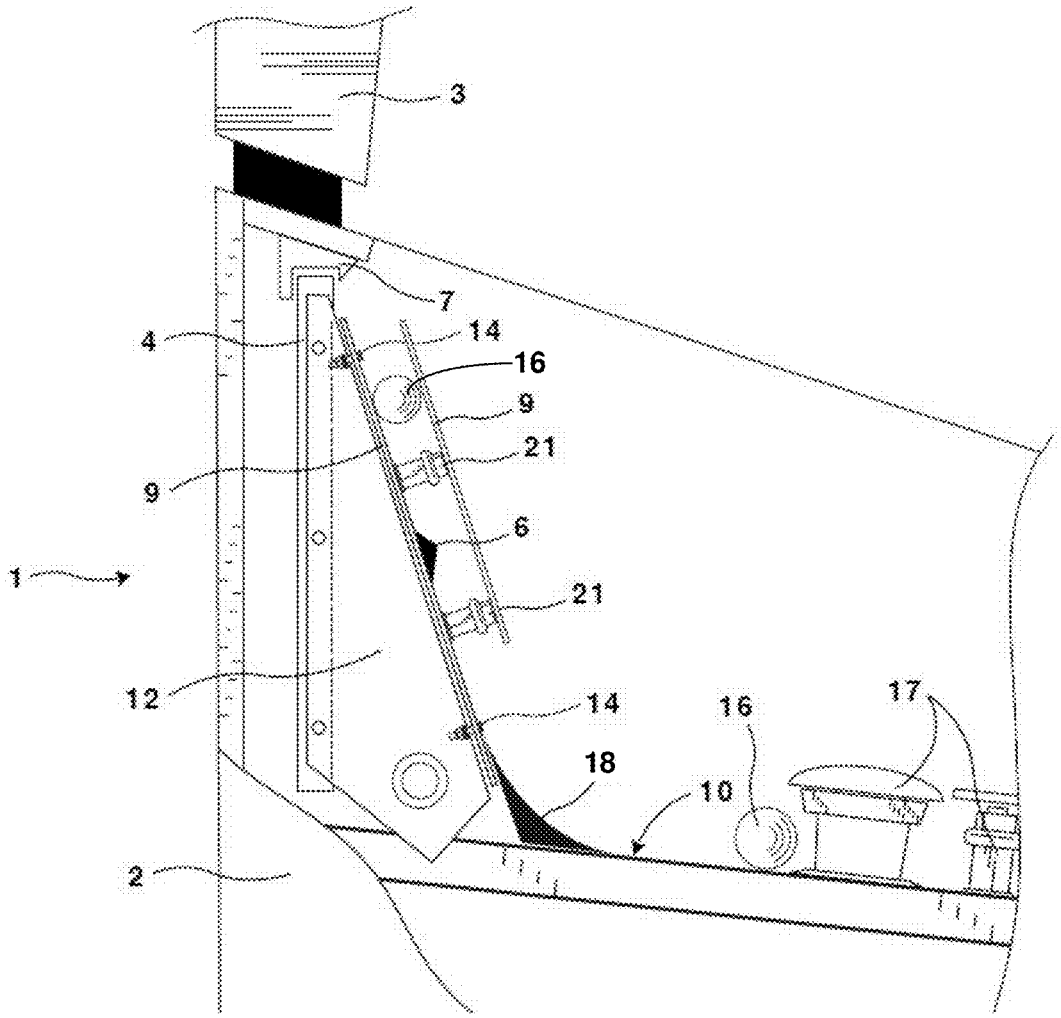
FIG. 6 is a side view of a portion of an exemplary pinball machine according to still further exemplary embodiments of the present disclosure.

A side view of a portion of a pinball machine 1 in accordance with further exemplary embodiments of the disclosure is shown in FIG. 6. One or more ball lanes or guides 21 can be provided directly in front of the display 4, e.g., mounted on or formed as part of the panel 9. Such ball guides 21 can also be supported by posts or other structures affixed to the playfield 10 in front of the display 4, etc. Such ball guides 21 or other game elements 17, placed proximal to the display 4, can be formed using an optically conductive material, such that portions of the guide 21, game element 17, and/or surrounding objects may be illuminated by light projected by the display 6. The optional ball guides 21 can be configured to direct the pinball 16 along a path that is at least partially proximal to the display 4, and one or more sensors 6 can be provided on or adjacent to the guides 21 to detect the presence of the pinball 16. Such sensors 6 can communicate with the CPU 15, which can then generate signals that cause particular graphical elements 20 to be displayed on the display 4. Such graphical elements 20, which may be animated, can be designed or selected to appear as a direct interaction with the physical pinball 16.

Figure 7:
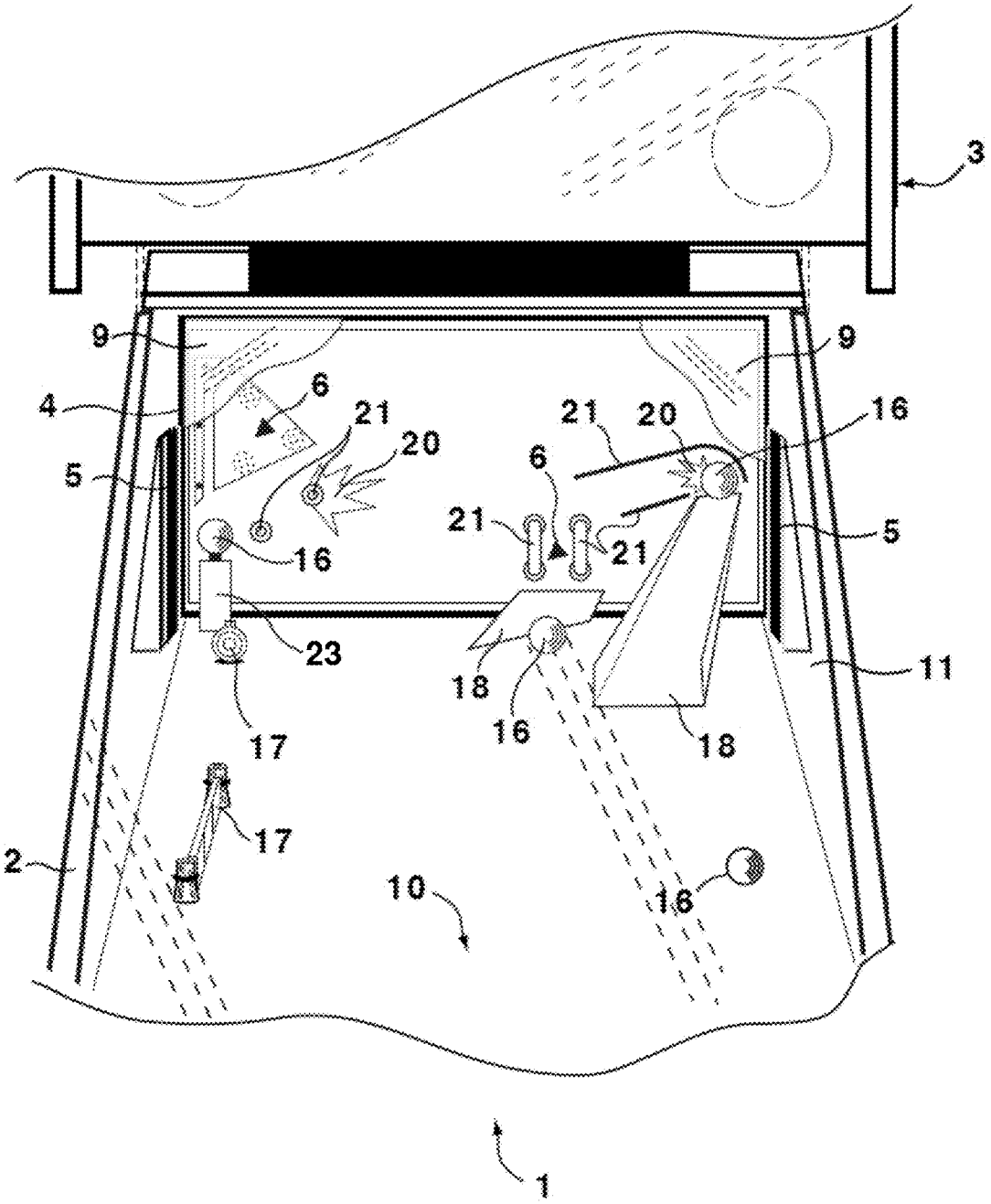
FIG. 7 is a frontal view of a portion of an exemplary pinball machine according to yet further exemplary embodiments of the present disclosure.

A front view of a portion of a pinball machine 1 in accordance with still further exemplary embodiments of the disclosure is shown in FIG. 7. As described above, various types of sensors 6 can be placed proximal to the display 4, e.g., on the panel 9, or affixed to the playfield 10 or other structures proximal to the display 4. These sensors can be activated by contact with or proximity to the pinball 16 or other moving objects provided in the pinball machine 1. Ball guides 21 or other structures can be placed on or proximal to various regions of the display surface to guide the pinball 16 towards, along, and/or away from the display 4.

For example, a kicker 23 can be provided and configured to project a pinball 16 onto or along the front of the display 4 and/or panel 9. If the pinball 16 passes near or in front of the sensor 6, e.g., the sensor 6 shown in the upper left portion of the display 4 in FIG. 7, then particular images can then be shown on the display 4 as described herein. As a further example, a pinball 16 can be directed up the ramp 18 during gameplay, as shown on the right side of FIG. 7. A sensor 6 (not shown) provided at the top of ramp 18 (e.g., mounted to the ramp 16 or on the panel 9) can be activated when the pinball 16 travels up the ramp 18. This can cause a graphical element 20 to appear on the display 4 such as, e.g., the star-shaped element 20 shown in FIG. 7. In this manner, the motion of the pinball 16 towards the display 4 can appear to have a direct visual effect on the display 4, e.g., it can appear to hit or otherwise affect certain graphical elements 20 that may appear on the display 4. The pinball 16 may further move along or proximal to the display, e.g., directed by ball guides 21, such that the pinball 16 may activate further sensors 6 and lead to generation of further graphical elements 20 on the display 4.

The embodiments described and illustrated herein are exemplary and do not limit the scope of the described and claimed invention. For example, one or more displays 4 can be provided at different locations within the pinball machine 1, e.g., at one or more locations along the sides of the playfield 10. Such displays 4 may have various sizes, and can be associated with an embedded CPU 15 instead of or in addition to one or more primary CPUs 15 used in the pinball machine 1. The game elements 17 and ramps 18 can be varied, e.g., different numbers, sizes, shapes, and locations of features such as bumpers, lane guides, etc., ramps 18, ball guides 21, kickers 23, etc. can be provided at various locations on the playfield 10. The playfield 10 may further include different surfaces provided at different angles and/or elevations within the cabinet 2, with ramps 18 or other game elements 17 providing pathways for the pinball 16 to travel among them. These and other design variations are common among different pinball machine layouts. Further, embodiments of the present disclosure can also be used in other amusement and entertainment devices besides pinball machines, such as advertising kiosks or other electronic amusement devices, to create apparent interactions between physical objects and graphical images.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

It will thus be appreciated that those skilled in the art will be able to devise numerous systems, arrangements and methods which, although not explicitly shown or described herein, embody the principles of the invention and are thus within the spirit and scope of the present disclosure. In addition, all publications, patents and patent applications referenced herein are incorporated herein by reference in their entireties.

What is claimed is:

1. A pinball game, comprising:

a cabinet;

an inclined playfield provided within the cabinet and configured to support a rolling ball and a plurality of game play elements;

a video display provided within the cabinet and proximal to the playfield;

at least one sensor provided proximal to the video display; and a processor arrangement provided in communication with the at least one sensor and the video display;

wherein the at least one sensor is configured to detect at least one of contact with or proximity to the ball, and to generate a signal based on such detection;

wherein the processor arrangement is configured to receive the signal and cause at least one graphical element to be displayed on the video display and proximal to the at least one sensor based on the signal; and wherein the at least one graphical element appears to result from a physical interaction between the ball and the video display.

2. The pinball game of claim 1, wherein the video display is at least one of an LED display, an LCD display, a plasma display, or an OLED display.

3. The pinball game of claim 1, wherein the at least one sensor comprises at least one of a mechanical switch, an opto-electronic detector, a reed switch, a magnetic switch, a pressure-sensitive film, an eddy sensor, an induction sensor, a touchscreen, or an acoustical sensor.

4. The pinball game of claim 1, wherein the video display is provided proximal to a rearward portion of the playfield.

5. The pinball game of claim 4, wherein the video display is provided in a substantially vertical orientation.

6. The pinball game of claim 1, wherein the at least one graphical element appears to result from a physical interaction between the ball and the video display.

7. The pinball game of claim 1, further comprising a panel provided in front of and proximal to at least a portion of the video display, wherein a portion of the panel is at least one of transparent or translucent.

8. The pinball game of claim 7, wherein at least one sensor is affixed to the panel.

9. The pinball game of claim 8, wherein the at least one graphical element appears to result from a physical interaction between the ball and the panel.

10. The pinball game of claim 7, further comprising at least one object affixed to the panel that is configured to affect motion of the ball.

11. The pinball game of claim 10, wherein the at least one graphical element appears to result from a physical interaction between the ball and the at least one object.

12. The pinball game of claim 1, wherein the video display is affixed to the playfield.

13. The pinball game of claim 1, further comprising a cabinet enclosing at least a portion of the playfield, wherein the video display is supported by the cabinet.

14. The pinball game of claim 13, wherein the video display is pivotally coupled to the cabinet.

15. The pinball game of claim 1, wherein the processor arrangement is further configured to produce at least one sound based on the signal.

16. The pinball game of claim 1, wherein the at least one graphical element is displayed on the video display.

17. The pinball game of claim 1, wherein the processor arrangement is further configured to display at least one further graphical element on the video display, and wherein the at least one graphical element appears to result from a physical interaction between the ball and the at least one further graphical element.

18. The pinball game of claim 1, wherein the processor arrangement is further configured to cause at least one animation to be displayed on the video display proximal to the at least one sensor based on the signal.

19. The pinball game of claim 18, wherein the at least one animation appears to result from a physical interaction between the ball and the video display.

* * * * *